US009941069B2

(12) United States Patent
Chen

(10) Patent No.: US 9,941,069 B2
(45) Date of Patent: Apr. 10, 2018

(54) SWITCH-TYPE KEY STRUCTURE

(71) Applicant: Chicony Electronics Co., Ltd., New Taipei (TW)

(72) Inventor: Chih-Hao Chen, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 26 days.

(21) Appl. No.: 15/370,115

(22) Filed: Dec. 6, 2016

(65) Prior Publication Data

US 2018/0075986 A1 Mar. 15, 2018

(30) Foreign Application Priority Data

Sep. 9, 2016 (TW) ..... 105213970 U

(51) Int. Cl.

| | |
|---|---|
| ***H01H 13/14*** | (2006.01) |
| *H01H 13/70* | (2006.01) |
| *H01H 13/705* | (2006.01) |
| *H01H 3/12* | (2006.01) |
| *H01H 13/83* | (2006.01) |

(52) U.S. Cl.

CPC ..... *H01H 13/14* (2013.01); *H01H 3/125* (2013.01); *H01H 13/70* (2013.01); *H01H 13/705* (2013.01); *H01H 13/83* (2013.01)

(58) Field of Classification Search

CPC ..... H01H 3/125; H01H 13/14; H01H 13/70; H01H 13/83; H01H 13/705; H01H 9/26; H01H 13/72; H01H 25/00; H01H 25/04; H01H 1/02

USPC ..... 200/5 A, 341–345, 512, 312; 400/490, 400/491, 491.2, 495.1, 496

See application file for complete search history.

(56) References Cited

U.S. PATENT DOCUMENTS 5,912,443 A * 6/1999 Hasunuma ..... H01H 13/705 200/343

2013/0140165 A1* 6/2013 Lin ..... G06F 3/0202 200/5 A

* cited by examiner

*Primary Examiner* — Ahmed Saeed

(74) *Attorney, Agent, or Firm* — Chun-Ming Shih; HDLS IPR Services

(57) ABSTRACT

An improved switch-type key structure includes a support plate, a microswitch, a connection element, and a key cap. The microswitch is fixed onto the support plate and is electrically connected thereto. The connection element is movably disposed on the support plate. The connection element includes a balance portion and a support portion extending downward from the balance portion. The key cap is disposed on the balance portion. The connection element is disposed between the support plate and the key cap through the microswitch, a hook hole corresponding to the support portion is disposed on the support plate, a hook is disposed at a distal end of the support portion, and the hook passes through the hook hole to engage the connection element with the support plate. Accordingly, the key cap is stressed evenly, returns instantly after being depressed, and is prevented from vibrations/wobbles.

11 Claims, 4 Drawing Sheets

SWITCH-TYPE KEY STRUCTURE

TECHNICAL FIELD

The present invention relates to keys of a keyboard and, in particular, to an improved switch-type key structure.

BACKGROUND

FIG. 1 shows a conventional switch-type key, wherein a plurality of mechanical microswitches 2*a* are welded onto a circuit board 1*a* of a keyboard, and a key cap 3*a* is fixed onto the microswitch 2*a*. By pressing the key cap 3*a*, the microswitch 2*a* is actuated to achieve a keystroke.

However, in the conventional switch-type key, the key cap 3*a* is only supported by the microswitch 2*a*. Consequently, when a user types on the keyboard, there may be a slight deviation in the pressed position on the key cap 3*a*, leading to an uneven stress distribution of the key cap 3*a*. Thus, the key cap 3*a* is prone to wobble/vibrate when the user types on the keyboard, causing an unpleasant tactile sensation. Besides, the key cap 3*a* is detached easily, so the conventional switch-type key has a short lifespan.

Accordingly, the target of the inventor is to solve the above-mentioned problems, on the basis of which the present invention is accomplished.

SUMMARY

It is one object of the present invention to provide an improved switch-type key structure wherein a key cap receives even stress, returns instantly upon depression of a key, and is prevented from vibrations/wobbles.

Accordingly, the present invention provides an improved switch-type key structure which includes a support plate, a microswitch, a connection element, and a key cap. The microswitch is fixed onto the support plate and electrically connected thereto. The connection element is movably disposed on the support plate. The connection element includes a balance portion and a support portion extending downward from the balance portion. The key cap is disposed on the balance portion. The connection element is disposed between the support plate and the key cap through the microswitch, a hook hole corresponding to the support portion is disposed on the support plate, a hook is disposed at a distal end of the support portion, and the hook passes through the hook hole to engage the connection element with the support plate.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
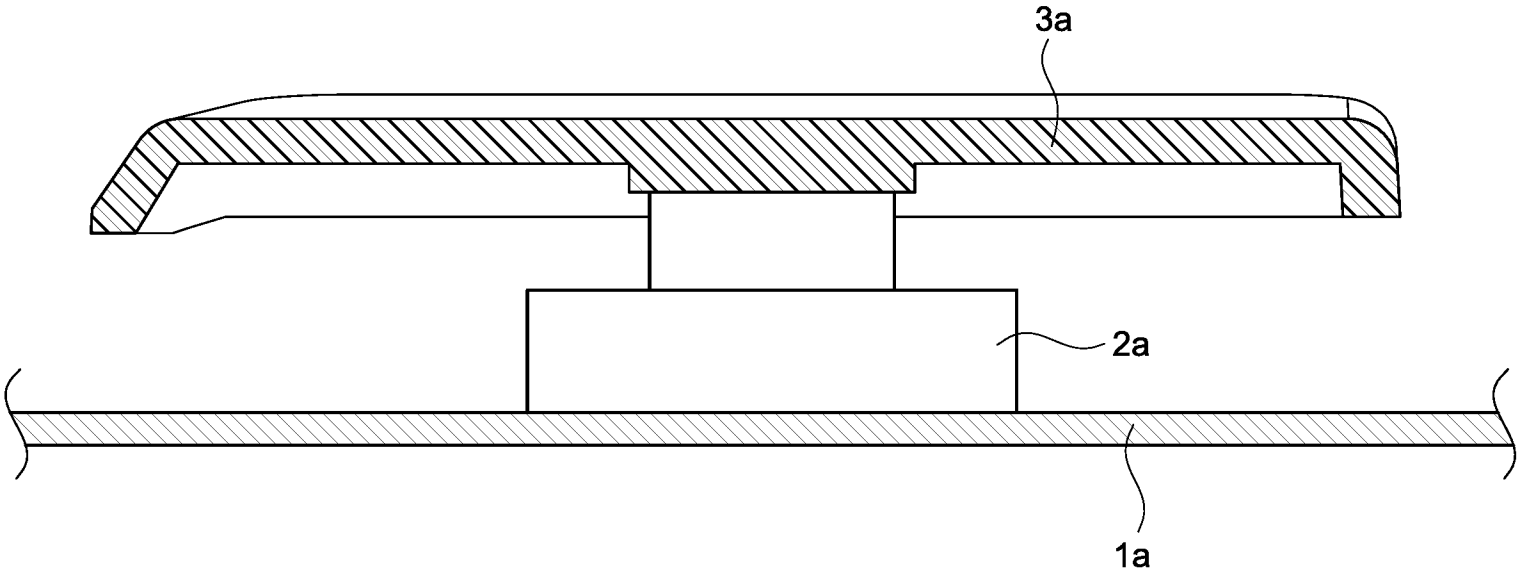
FIG.1 (Related Art)
FIG. 1 is a cross-sectional view illustrating a conventional switch-type key.
Figure 2:
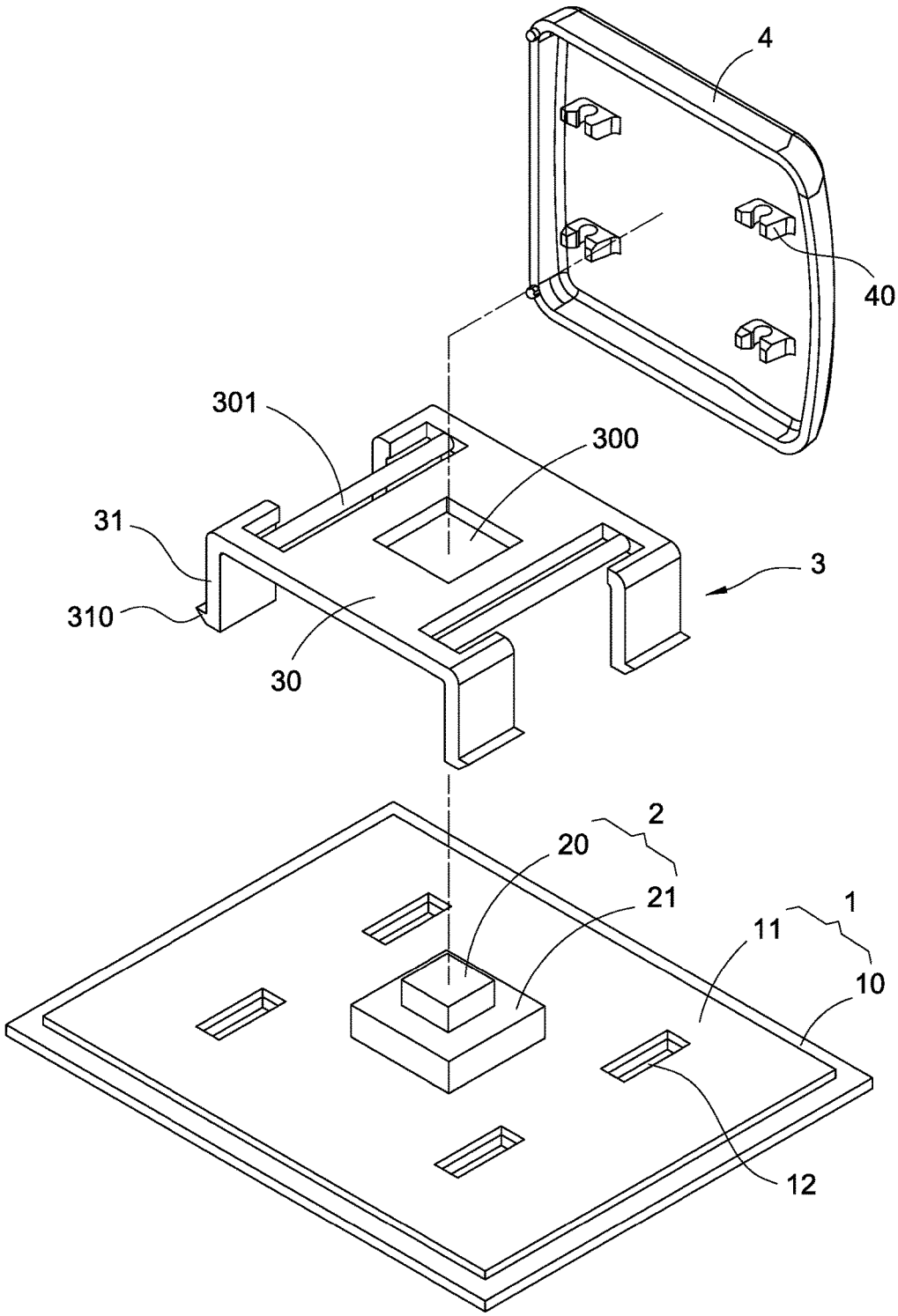
FIG. 2 is a perspective exploded view illustrating an improved switch-type key structure according to a first embodiment of the present invention.
Figure 3:
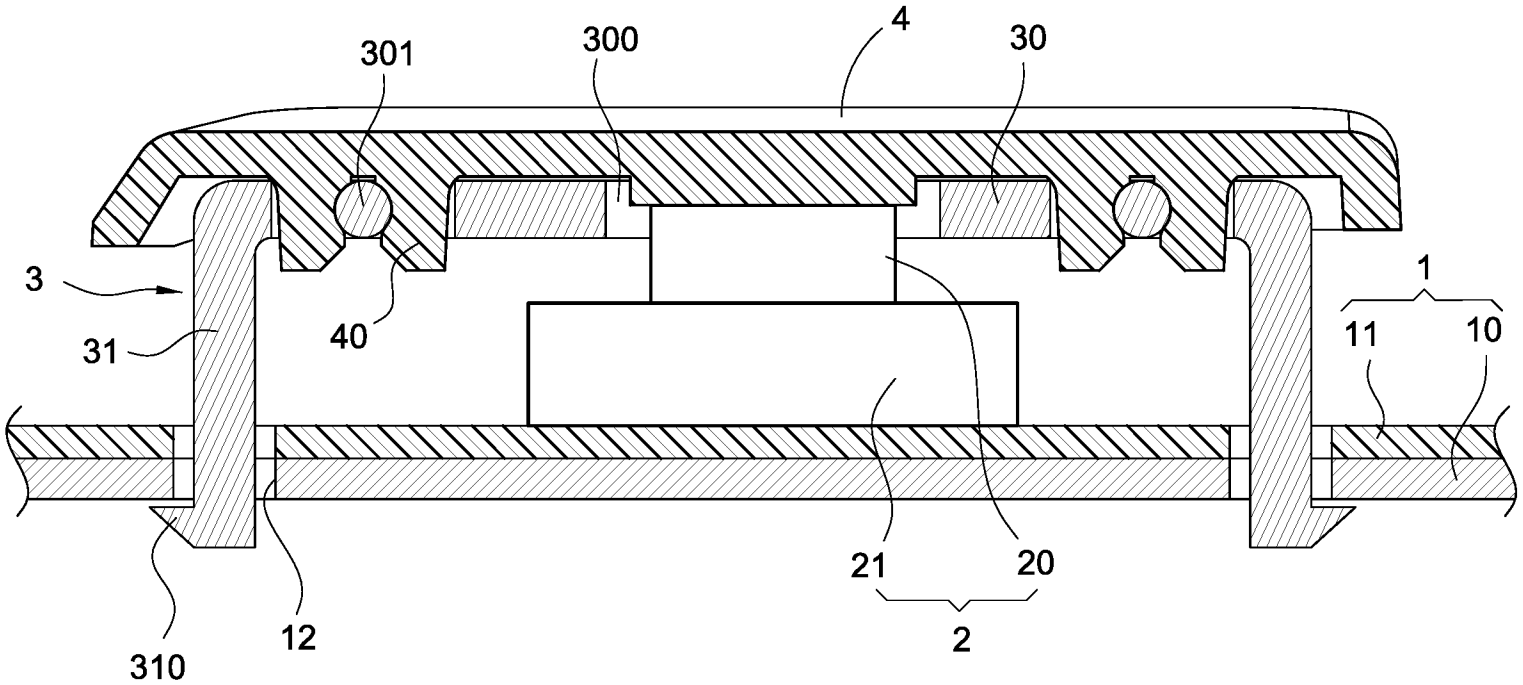
FIG. 3 is a cross-sectional assembled view according to the first embodiment of the present invention.

Please refer to FIGS. 2 and 3, showing a perspective exploded view and a cross-sectional assembled view according to a first embodiment of the present invention. The present invention provides an improved switch-type key structure, comprising a support plate 1, a microswitch 2, a connection element 3, and a key cap 4.

The support plate 1 is used to hold other components (e.g. the mircroswitch 2, the connection element 3 and the key cap 4). A circuit layer 11 is disposed on the support plate 1. The support plate 10 can be a metal plate (a rigid plate) disposed below the circuit layer 11 to support the connection element 3 movably connected to the support plate 10 and to improve the structural strength of the circuit layer 11. The circuit layer 11 can be a flexible circuit board or a rigid circuit board, electrically connected to the microswitch 2. For example, the microswitch 2 can be welded onto the circuit layer 11.

The microswitch 2 is fixed onto the support plate 1 and is electrically connected to the circuit layer 11 on the support plate 1. The microswitch 2 includes an actuator portion 20 and a switch portion 21. The actuator portion 20 is movably connected to the switch portion 21 and produces an electronic signal when the actuator portion 20 moves with respect to the switch portion 21. The microswitch is a conventional technique, not within the protection scope of the present invention, so a detailed description is omitted for brevity.

The present invention is featured by the connection element 3 movably disposed on the support plate 1. The key cap 4 is disposed on the connection element 3. The connection element 3 is disposed between the support plate 1 and the key cap 4 through the microswitch 2. The key cap 4 is connected to the connection element 3 and moves together with the connection element 3. Upon depression of the key cap 4, the actuator portion 20 of the microswitch 2 is actuated to make a keystroke. The connection element 3 includes a balance portion 30 and support portions 31 extending downward from a periphery of the balance portion 30. The support portions 31 can be disposed at or near four corners of the balance portion 30 respectively. Multiple hook holes 12 respectively corresponding to the support portions 31 are disposed on the support plate 1. A hook 310 is disposed at a distal end of each support portion 31, and the hook 310 passes through the hook hole 12 to engage the connection element 3 with the support plate 1. The balance portion 30 is preferably in contact with a bottom surface of the key cap 4. When the key cap 4 is depressed, the connection element 3 receives even stress. A through hole 300 is disposed on the balance portion 30, and the actuator portion 20 of the microswitch 2 is inserted through the through hole 300 of the balance portion 30, so that the actuator portion 20 is actuated when the key cap 4 is depressed. The actuator portion 20 can otherwise be actuated by pressing the key cap 4 to drive movement of the balance portion 30. The balance portion 30 comprises the through hole 300 which the microswitch 2 is extending from. The balance portion 30 further comprises two openings formed on opposite sides of the balance portion 30 and the through hole 300 is positioned between the two openings. The balance portion 30 can also include a joint portion 301 as a column positioned within each opening of the balance portion 30. The joint portion 301 can be joined with a pivot portion 40 conventionally disposed below a bottom surface of a conventional key cap 4, i.e., specifically, a plurality of pivoting portions 40 are disposed below a bottom surface of the key cap, each column 301 of the balance portion 30 receives two pivoting portions 40, and the key cap 4 is pivotally supported on the balance portion 30, thereby the present invention can use the conventional key cap 4, which saves design works and molding costs for making the key cap 4.

Accordingly, the improved switch-type key structure of the present invention can be constituted by the above-mentioned components and configurations.

Referring to FIG. 3, the connection element 3 is disposed between the support plate 1 and the key cap 4, and the connection element 3 is movably disposed on the support plate 1 by means of the support portion 31 of the connection element 3. As a result, the key cap 4 can depress the microswitch 2 more stably, and thereby the key cap 4 is stressed evenly when a user types on a keyboard. In addition to that, the key cap 4 can be pushed up instantly while the microswitch returns after depression, and consequently, the key cap 4 is prevented from wobbles/vibrations during down and up motions of the key cap 4. Furthermore, by disposing the support plate 10 below the circuit layer 11, the circuit layer 11 is prevented from deforming by depression stresses. Thus, this reduces a risk of breaks of key or other structural damages.

Figure 4:
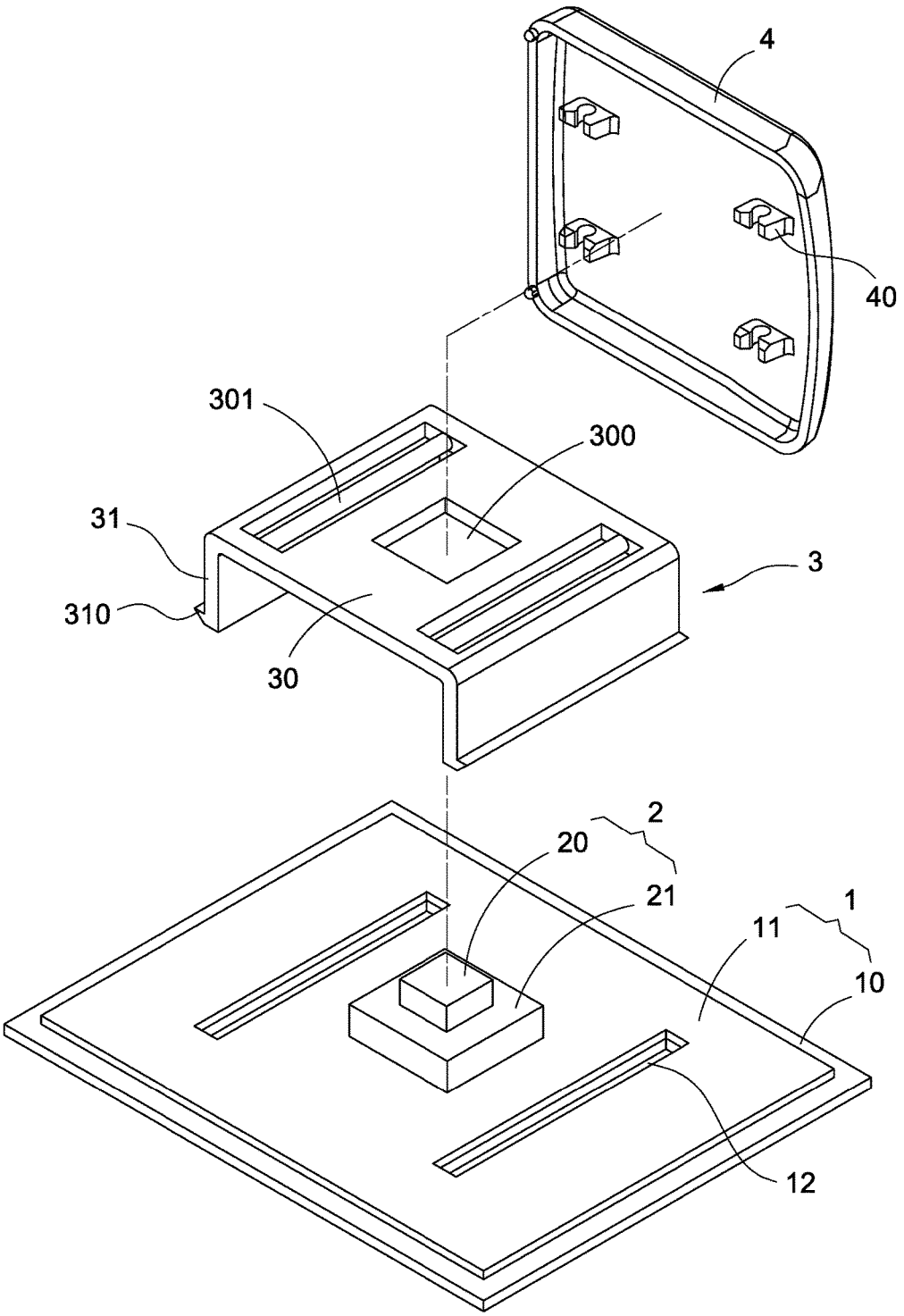
FIG. 4 is a cross-sectional assembled view according to a second embodiment of the present invention.

It should be noted that, the support portion 31 of the connection element 3 can have various types. The support portions 31 can be disposed at four corners of the balance portion 30, as shown in FIG. 3. Alternatively, the support portions 31 can be disposed at two opposite sides of the balance portion 30, as shown in FIG. 4. However, the aforesaid types are merely examples, and the present invention is not limited in this regard.

In summary, the present invention certainly can achieve anticipated objectives and solve the conventional defects. The present invention also has novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A switch-type key structure, comprising:

a support plate;

a microswitch fixed onto the support plate and electrically connected thereto;

a connection element movably disposed on the support plate, the connection element including a balance portion, a support portion extending downward from the balance portion, wherein the balance portion comprises a through hole which the microswitch is extending from; and the balance portion further comprising;

two openings formed on opposite sides of the balance portion and the through hole is positioned between the two openings; and two columns positioned within the openings of the balance portion;

a key cap having a plurality of pivoting portions disposed below a bottom surface of the key cap; wherein each column of the balance portion receives two pivoting portions; wherein the key cap is pivotally supported on the balance portion;

wherein the connection element is disposed between the support plate and the key, a hook hole corresponding to the support portion is disposed on the support plate, and the support portion passes through the hook hole to engage the connection element with the support plate.

2. The switch-type key structure of claim 1, wherein a circuit layer overlaps the support plate.

3. The switch-type key structure of claim 2, wherein the support plate is disposed below the circuit layer.

4. The switch-type key structure of claim 2, wherein the support plate is a metal plate.

5. The switch-type key structure of claim 2, wherein the circuit layer is a flexible circuit board or a rigid circuit board.

6. The switch-type key structure of claim 1, wherein the microswitch includes an actuator portion and a switch portion.

7. The switch-type key structure of claim 6, wherein the actuator portion of the microswitch is inserted through the through hole, and the actuator portion is actuated when the key cap is depressed.

8. The switch-type key structure of claim 1, wherein the balance portion of the connection element is in contact with the bottom surface of the key cap.

9. The switch-type key structure of claim 1, wherein the connection element includes multiple support portions extending downward from a periphery of the balance portion.

10. The switch-type key structure of claim 9, wherein the support portions are disposed at four corners of the balance portion.

11. The switch-type key structure of claim 9, wherein the support portions are disposed at two opposites sides of the balance portion.

* * * * *